US006443710B1

(12) United States Patent
Tatsukami et al.

(10) Patent No.: US 6,443,710 B1
(45) Date of Patent: Sep. 3, 2002

(54) MAGNETIC PUMP

(75) Inventors: Kiyoshi Tatsukami; Yoshihiro Iba; Toshinori Yanagihara; Kazuo Okada, all of Sayama (JP)

(73) Assignee: Iwaki Co., Ltd., Tokyo (JP)

( * ) Notice: Subject to any disclaimer, the term of this patent is extended or adjusted under 35 U.S.C. 154(b) by 0 days.

(21) Appl. No.: 09/807,030

(22) PCT Filed: Aug. 9, 2000

(86) PCT No.: PCT/JP00/05317

§ 371 (c)(1),
(2), (4) Date: Apr. 17, 2001

(87) PCT Pub. No.: WO01/12993

PCT Pub. Date: Feb. 22, 2001

(30) Foreign Application Priority Data

Aug. 10, 1999 (JP) ..... 11-225982
Aug. 10, 1999 (JP) ..... 11-225983

(51) Int. Cl.[7] ..... F04B 17/00
(52) U.S. Cl. ..... 417/365; 417/420
(58) Field of Search ..... 417/365, 420

(56) References Cited

U.S. PATENT DOCUMENTS 3,364,866 A * 1/1968 Sato ..... 417/365
4,752,194 A * 6/1988 Wienen et al. ..... 417/420
5,464,333 A * 11/1995 Okada et al. ..... 417/420
5,501,582 A * 3/1996 Gautier et al. ..... 417/420
5,779,449 A 7/1998 Klein ..... 417/420

FOREIGN PATENT DOCUMENTS

JP A 5-26196 2/1993
JP A 5-44684 2/1993
JP A 7-293486 11/1995
JP A 11-324969 11/1999

* cited by examiner

*Primary Examiner*—Timothy S. Thorpe
*Assistant Examiner*—Michael K. Gray
(74) *Attorney, Agent, or Firm*—Oliff & Berridge PLC

(57) ABSTRACT

A magnetic pump comprises a front casing (1) for forming an interior pump space (2) and having an inlet (3) for drawing in a fluid to be pumped and an outlet (4) for discharging the fluid, a rear casing (6) for forming a cylindrical space (5) extending from the pump space (2), a supporting shaft (7) having a rear end supported by a rear end of the rear casing (6) and a front end facing to the pump space (2), and a rotator (10) rotatably supported by the supporting shaft (7). The rotator (10) includes a totally cylindrical magnetic can (13) having an inner circumference on which a cylindrical rotary bearing mounted and an outer circumference on which a driven magnet is mounted, and an impeller (14) secured on a front end of the magnetic can (13) and accommodated in the pump space (2) so as to rotate integrally with the magnetic can (13). A rear bearing (19) is located at a rear end of the rotary bearing (11) via a cushion member (18). A rear thrust bearing (20) is arranged at a portion opposite to the rear bearing in the thrust direction for contacting the rear bearing (19) when the rotary bearing (11) moves backward during an abnormal run of the pump. One of the rear bearing (19) and the rear thrust bearing (20) has such a tapered cross section that reduces a sliding area.

9 Claims, 5 Drawing Sheets

MAGNETIC PUMP

TECHNICAL FIELD

The present invention relates to a magnetic pump, in which a rotator, consisting of an impeller and a magnetic can, is rotatably supported by a supporting shaft and the magnetic can is rotationally driven from the outside of a rear casing.

BACKGROUND ART

In such the magnetic pump, a front casing forms a pump space and a rear casing forms a cylindrical space extending from the pump space. Arranged in the cylindrical space of the rear casing is a cylindrical magnetic can that is rotatably supported by a supporting shaft of which one end is secured on the rear casing. A rotary driving means, magnetically coupled to the magnetic can via the rear casing, is located outside the magnetic can to rotate the magnetic can with a driving force from the rotary driving means. The magnetic can is integrally coupled to an impeller that is accommodated in the pump space. When the impeller rotates, a fluid to be pumped is drawn into inside the pump space through an inlet located at the front of the front casing and then the fluid is discharged through an outlet located at a side of the front casing.

The following methods are employed in the art to couple the magnetic can with the impeller. (1) The impeller and the magnetic can are press-fitted or frictionally secured with each other using a cushion member. (2) The impeller and the magnetic can are coupled to each other with a screw. (3) The impeller and the magnetic can are coupled to each other with a weld.

The rotator consisting of the magnetic can and the impeller is supported on the supporting shaft by a cylindrical rotary bearing. The rotary bearing is movable in the thrust direction. During normal runs, when the fluid is pumped, the rotator totally slides forward because the inlet is negatively pressurized. During idling runs when the fluid is not present and abnormal runs such as an air involving run, the rotator totally slides backward because of a magnetic attractive force between the magnetic can and the rotary driving means. As a result, the rear surface of the rotary bearing contacts a thrust bearing of a casing opposite to that surface.

The magnetic pump mentioned above has several disadvantages in its reliability. First, it is difficult to maintain a stable state of coupling between the magnetic can and the impeller for a long term. For example, in the above method (1), the impeller possibly separates from the magnetic can due to the lowered coupling force reduced in accordance with an elapsed time or when a liquid at a high temperature is pumped. In the coupling method (2), the coupling portion is loosen by an inertial force when the pump is rotated erroneously or when the pump is stopped, thereby resulting in a possibility that separates the impeller from the magnet. In the coupling method (3), disadvantageously, it takes a long production time and moreover it is impossible to change parts once assembled.

Second, in the magnetic pump mentioned above, at the times of initial driving and abnormal runs such as idling and air involving runs, the rear end of the bearing of the rotator contacts the rear thrust bearing. As a result, the pump is possibly broken due to an impact at that moment and a sliding heat between the rear thrust bearing and the bearing end.

DISCLOSURE OF THE INVENTION

The present invention has been made in consideration of the above disadvantages and accordingly has a general object to provide a magnetic pump with an improved reliability.

More specifically, the present invention has an object to provide a magnetic pump capable of maintaining a stable state of coupling between an impeller and a magnetic can for a long term, in which parts can be changed individually with ease.

Moreover, the present invention has another object to provide a magnetic pump that is not damaged due to a heat and an impact at the times of idling and abnormal running such as air involving.

The present invention is provided with a magnetic pump, comprising: a front casing forming an interior pump space and having an inlet for drawing in a fluid to be pumped and an outlet for discharging the fluid; a rear casing for forming a cylindrical space extending from the pump space; a supporting shaft arranged in the cylindrical space and having a rear end supported by a rear end of the rear casing and a front end facing to the pump space; a totally cylindrical magnetic can rotatably supported by the supporting shaft and having an inner circumference on which a cylindrical rotary bearing is mounted and an outer circumference on which a driven magnet is mounted; an impeller secured on a front end of the magnetic can and accommodated in the pump space so as to rotate integrally with the magnetic can; a rotary driving means magnetically coupled to the driven magnet via the rear casing for supplying a rotary driving force to the impeller via the driven magnet; a rear bearing arranged at a rear end of the rotary bearing; and a rear thrust bearing arranged at a portion opposite to the rear bearing of the rear casing for contacting the rear bearing when the rotary bearing moves backward during an abnormal run of the pump, wherein the magnetic can and the impeller are fitted with each other in the axial direction and coupled by a pin passing through both in the radial direction.

According to the present invention, the magnetic can is coupled to the impeller by a pin that passes through both in the radial direction. Therefore, the coupling force at the coupled portion is not lowered with aging and heating as well as an inertial force when the pump inversely rotates or stops. In addition, according to the present invention, the magnetic can is coupled to the impeller in the axial and rotational directions by a pin. Therefore, both can be easily decomposed/assembled and their parts are individually changeable.

Preferably, a coupling interface between the magnetic can and the impeller comprises a surface extending in the radial direction for transmitting a rotary driving force. In such the arrangement, the rotary driving force transmitting surface mainly secures the impeller with the magnetic can in the rotational direction (the direction in which the driving force is transmitted). Therefore, an excessively large load cannot impart on the pin, which can be thinned and downsized to that extent.

In addition, the pin may be inserted through the magnetic can and the impeller from the inner circumference to the outer circumference and it may be protected by the outer circumference of the rotary bearing not to be pulled out. In such the arrangement, once the magnetic can and the impeller are assembled, the pin can not be pulled out easily and can maintain a stable state of coupling.

The present invention is also provided with a magnetic pump, comprising: a front casing for forming an interior pump space and having an inlet for drawing in a fluid to be pumped and an outlet for discharging the fluid; a rear casing for forming a cylindrical space extending from the pump space; a supporting shaft arranged in the cylindrical space and having a rear end supported by a rear end of the rear casing and a front end facing to the pump space; a totally cylindrical magnetic can rotatably supported by the supporting shaft and having an inner circumference on which a cylindrical rotary bearing is mounted and an outer circumference on which a driven magnet is mounted; an impeller secured on a front end of the magnetic can and accommodated in the pump space so as to rotate integrally with the magnetic can; a rotary driving means magnetically coupled to the driven magnet via the rear casing for supplying a rotary driving force to the impeller via the driven magnet; a rear bearing arranged at a rear end of the rotary bearing; and a rear thrust bearing arranged at a portion opposite to the rear bearing of the rear casing for contacting the rear bearing when the rotary bearing moves backward during an abnormal run of the pump, wherein one of the rear bearing and the rear thrust bearing has such a cross section that reduces a sliding area.

According to the present invention, either the rear bearing that is located at the rear end of the rotary bearing or the rear thrust bearing that contacts the rear bearing has such a cross section that reduces a sliding area (for example, a tapered cross section). Therefore, a sliding heat between the rear bearing and the rear thrust bearing can be suppressed lower than that in the art enough to prevent an excessive heat. In addition, a total surface area increases at portions that do not slide. Therefore, a heat from the sliding portion can be dissipated efficiently more than a flat bearing. This can improve durability during abnormal runs.

A cushion member for shock absorbing may be interposed between the rear bearing and the rotary bearing. This can relieve an impact between the rear bearing and the rotary bearing when they contact with each other during abnormal runs and can prevent the pump from being damaged with the impact.

Furthermore, the rear bearing may have fans formed on a side opposite to the rear thrust bearing for supplying as a cooling liquid the fluid to a sliding portion between the rear bearing and the rear thrust bearing. The cooling liquid can be circulated by force to the sliding portion of the bearing to further improve a cooling effect.

BEST MODE FOR EMBODYING THE INVENTION

Preferred embodiments of the present invention will be described below with reference to the drawings.

Figure 1:
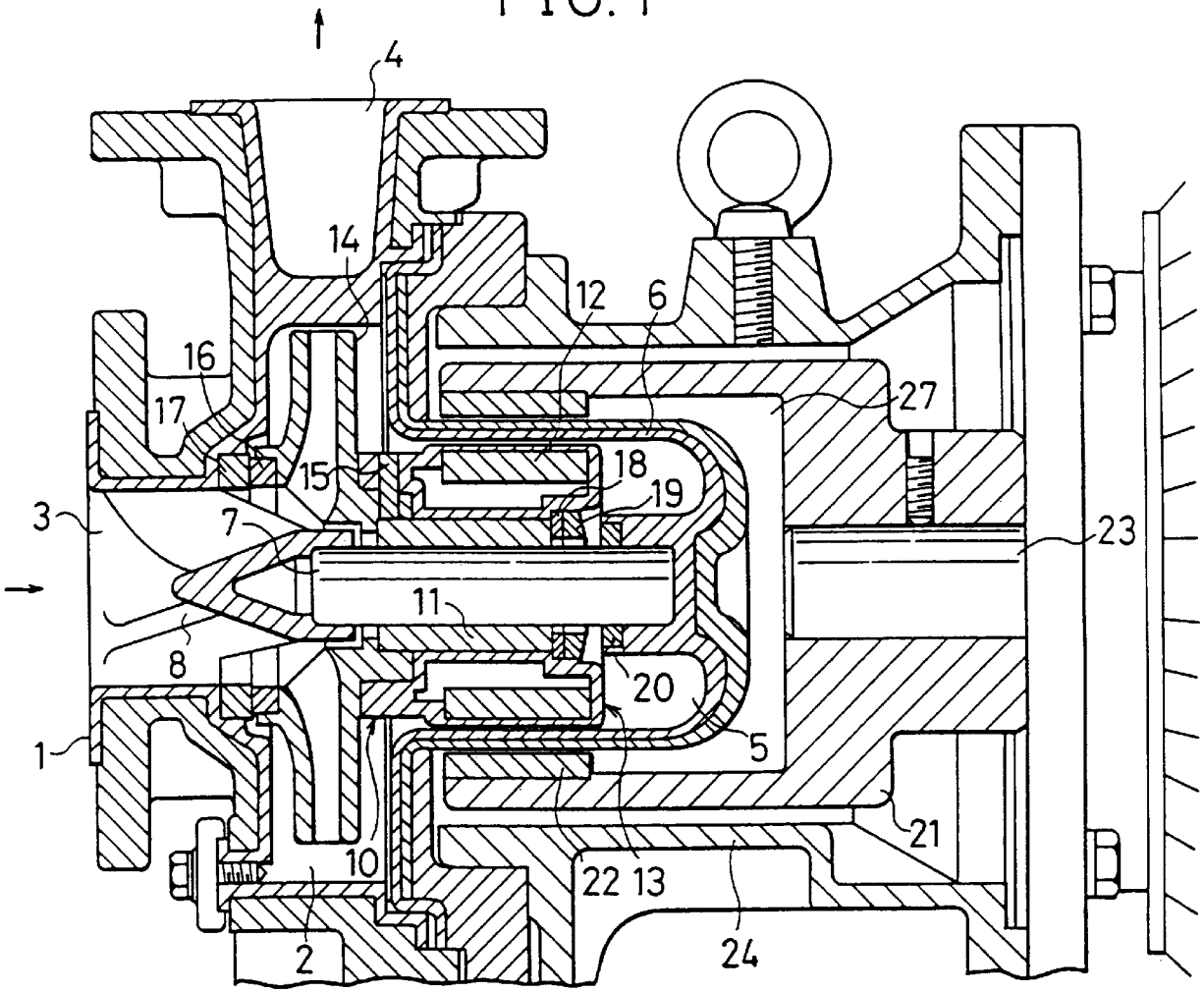
FIG. 1 is a cross sectional view showing a main part of a magnetic pump according to an embodiment of the present invention.

FIG. 1 is a cross sectional view showing a main part of a magnetic pump according to an embodiment of the present invention.

A front casing 1 forms a pump space 2 internally and has an inlet 3 at the front surface and an outlet 4 at an upper portion of the side. Located at the rear end of the pump space 2 is a rear casing 6 that forms a cylindrical space 5 extending from the pump space 2. A supporting shaft 7 is located in the cylindrical space 5 so that the front end of the shaft 7 faces to the pump space 2. The supporting shaft 7 has a rear end secured on a rear end of the rear casing 6 and a front end supported by shaft supports 8 extending from the inner circumference of the inlet 3 to the center, for example, in three directions.

A rotator 10 is rotatably supported on the supporting shaft 7. The rotator 10 comprises a cylindrical magnetic can 13 that corresponds to the cylindrical space 5. The magnetic can 13 includes a cylindrical rotary bearing 11 slidably mounted on the outer circumference of the supporting shaft 7 and an annular driven magnet 12 mounted on the outer circumference of the rotary bearing. The rotator 10 also comprises an impeller 14 secured on the front end of the magnetic can 13 to draw in a fluid to be pumped into the pump space 2 through the inlet 3 and discharges the fluid from the outlet 4 when the impeller rotates. Positioned at a fitting portion between the magnetic can 13 and the impeller 14 is a pin 15 that passes through both in the radial direction to restrict both moving in the rotational direction. A coupling structure between the magnetic can 13 and the impeller 14 will be detailed later.

An annular mouth ring 16 is mounted on the front surface of the impeller 14. An annular liner ring 17 is mounted on a position opposite to the mouth ring 16 inside the front casing 1. The mouth ring 16 and the liner ring 17 contact with each other when the rotator 10 slides forward during a normal run. An annular rear bearing 19 is located at a rear end of the rotary bearing 11 via a cushion member 18. The rear bearing 19 is formed to have a tapered cross section so as to protrude the inner circumferential side backward. An annular rear thrust bearing 20 is mounted on a portion of the rear casing 6, opposite to the rear bearing 19, for securing the supporting shaft 7. The rear bearing 19 contacts the rear thrust bearing 20 when the rotator 10 slides backward during an abnormal run.

Disposed at a position opposite to the driven magnet 12 in the magnetic can 13 via the rear casing 6 is an annular driving magnet 22 that magnetically couples to the driven magnet 12. The driving magnet 22 is contained in a driving rotator 21 or a rotary driving means. The driving rotator 21 is driven via a spindle 23 from a motor not depicted. The driving rotator 21 is isolated from the pump space 2 and accommodated in a space between the rear casing 6 and a driver casing 24.

In accordance with this magnetic pump, when the motor not depicted rotationally drives the driving rotator 21 via the spindle 23 to rotate the driving magnet 22, the driven magnet 12 magnetically coupled to the driving magnet 22 also rotates. As a result, the bearing 11 slides along the periphery of the supporting shaft 7 and the impeller 14 rotates to introduce the fluid to be pumped into the pump space 2 via the inlet 3. Then, the introduced fluid is discharged to external through the outlet 4.

Figure 2:
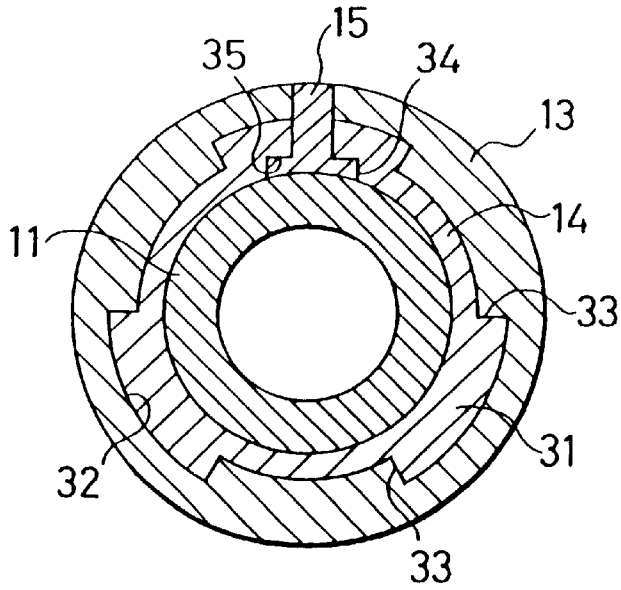
FIG. 2 is across sectional view of a coupling portion between an impeller and a magnetic can in the above magnetic pump taken along the axial direction.

FIG. 2 is across sectional view of a coupling portion between the magnetic can 13 and the impeller 14 taken along the direction of the supporting shaft 7. As shown in the figure, with the outer circumference of the rear end of the impeller 14 and the inner circumference of the front end of the magnetic can 13, both are fitted in the axial direction. Protrusions 31 are formed on the outer circumference of the fitting portion of the impeller 14 so as to protrude in three directions and grooves 32 are formed on the inner circumference of the corresponding fitting portion of the magnetic can 13 so as to fit the protrusions 31. These protrusions 31 and grooves 32 have sides or surfaces extending in the radial direction that form surfaces 33 for transmitting a rotary driving force.

After the magnetic can 13 is press-fitted with the impeller 14, the pin 15 is positioned so as to pass through both in the radial direction from the inner circumference to the outer circumference of the impeller 14. The pin 15 has a broader basic portion 34, which fits in a recess 35 formed in the inner circumference of the impeller 14 to fasten the magnetic can 13 with the impeller 14. Finally, the rotary bearing 11 is mounted on the inner circumference to completely prevent the pin 15 from being pulled out.

In the above coupling method, the rotary driving force is transmitted from the magnetic can 13 to the impeller 14 through the rotary driving force transmitting surfaces 33 and the pin 15 prevents one from being pulled out from the other in the axial direction. In this case, no load imparts on the pin 15 in the rotational direction. Further, insertion of the rotary bearing 11 almost completely prevents the pin 15 from dropping out.

Figure 3:
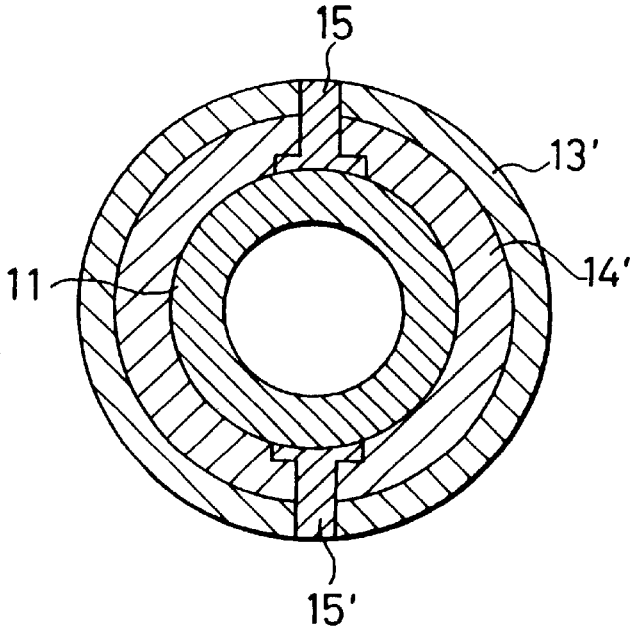
FIG. 3 is a cross sectional view showing another coupling structure between an impeller and a magnetic can taken along the axial direction.

FIG. 3 is a cross sectional view showing a coupling state between a magnetic can 13' and an impeller 14' taken along the axial direction in a magnetic pump according to another embodiment of the present invention. The driving force in the rotational direction is received on the rotary driving force transmitting surfaces 33 in the preceding embodiment while it is received by two pins 15, 15' and the protrusions 31 and grooves 32 are omitted in this embodiment. In this case, loads impart on the two pins 15, 15' in the rotational direction, though a more stable fastening can be achieved if the number of pins is increased like this example.

Figure 4:
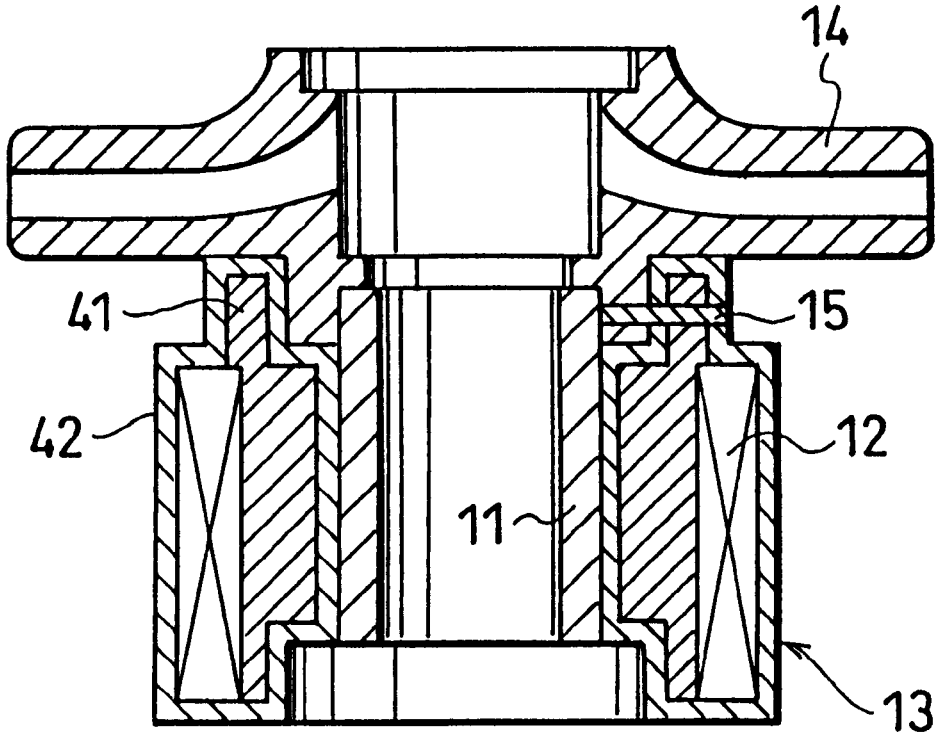
FIG. 4 is a cross sectional view showing another coupling structure between an impeller and a magnetic can taken along the direction normal to the axis.

FIG. 4 shows a further improved example of coupling structure between the impeller 14 and the magnetic can 13. The press-fitting portion between the impeller 14 and the magnetic can 13 is usually composed of a fluororesin and the like. Therefore, when a creep due to a rotational force during a run occurs in the resin, the coupling between the impeller 14 and the magnetic can 13 is loosened. In the structure of FIG. 4, to prevent the above situation, the magnetic can 13 has such a structure that includes a metallic cylinder 41 having inner and outer circumferences coated with a fluororesin 42. In addition, the fitting portion of the impeller 14 into the magnetic can 13 is sandwiched between the metal 41 and the bearing 11. This can highly improve the reliability of the coupling between the magnetic can 13 and the impeller 14.

In FIG. 1, the driving magnet 22 is arranged in a positional relation to attract the driven magnet 12 backward. Nevertheless, since the inlet 3 is negatively pressurized during normal runs for pumping the fluid, the rotator 10 totally slides forward and it rotates in a state that the mouth ring 16 slides on the liner ring 17. On the other hand, the negative pressure at the inlet 3 is not present at an idling run immediately after activation of the pump and at abnormal runs such as air involving. At that moment, the driven magnet 12 is attracted to the driving magnet 22 and the rotator 10 totally slides backward. As a result, the rear bearing 19 contacts the rear thrust bearing 20. The cushion member 18 absorbs a shock at the time of the contact. This shock relief can prevent the pump from being damaged. In addition, the rear bearing 19 has a tapered cross section to reduce a contact area with the rear thrust bearing 20. This can suppress a heat from sliding and prevent the peripheral resin from melting.

The rear bearing 19 with such the function may employ alumina ceramics with a high purity and SiC. In addition, the rear thrust bearing 20 may employ a non-adhesive material such as PTFE (polytetrafluoroethylene). Further, the cushion member 18 may employ a resin with a low thermal conductivity, for example, PTFE. In this case, the cushion member 18 has an effect because it hardly transmits a heat to the rotary bearing 11.

Figure 5:
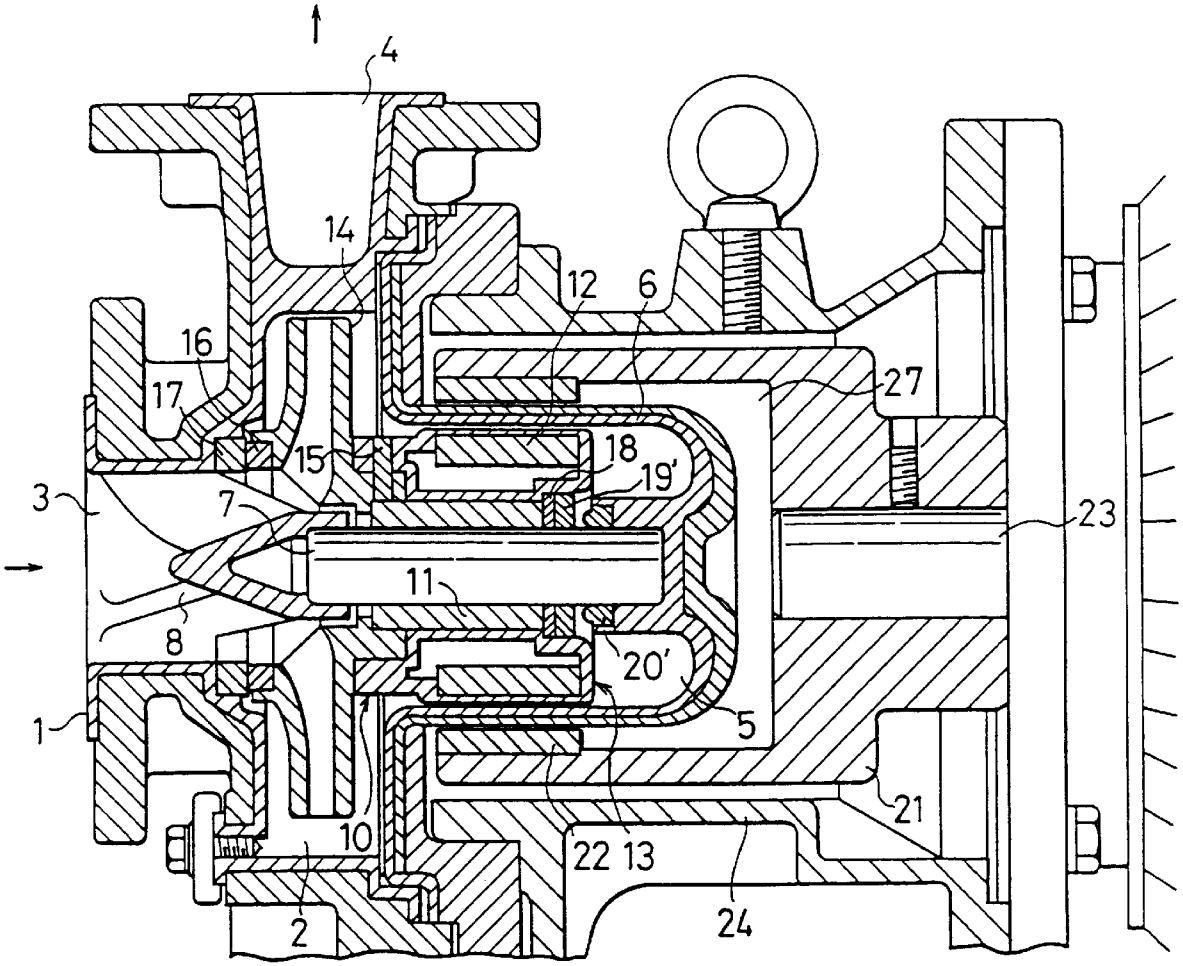
FIG. 5 is a cross sectional view showing a main part of a magnetic pump according to another embodiment.

FIG. 5 is a cross sectional view showing a magnetic pump according to another embodiment of the present invention. In the preceding embodiments the rear bearing 19 is formed to have the tapered cross section. To the contrary in this embodiment a rear thrust bearing 20' is formed to have a tapered cross section while a rear bearing 19' is determined to have a normal rectangular cross section. The basic operation in this embodiment is also similar to those in the preceding embodiments.

Figure 6A:
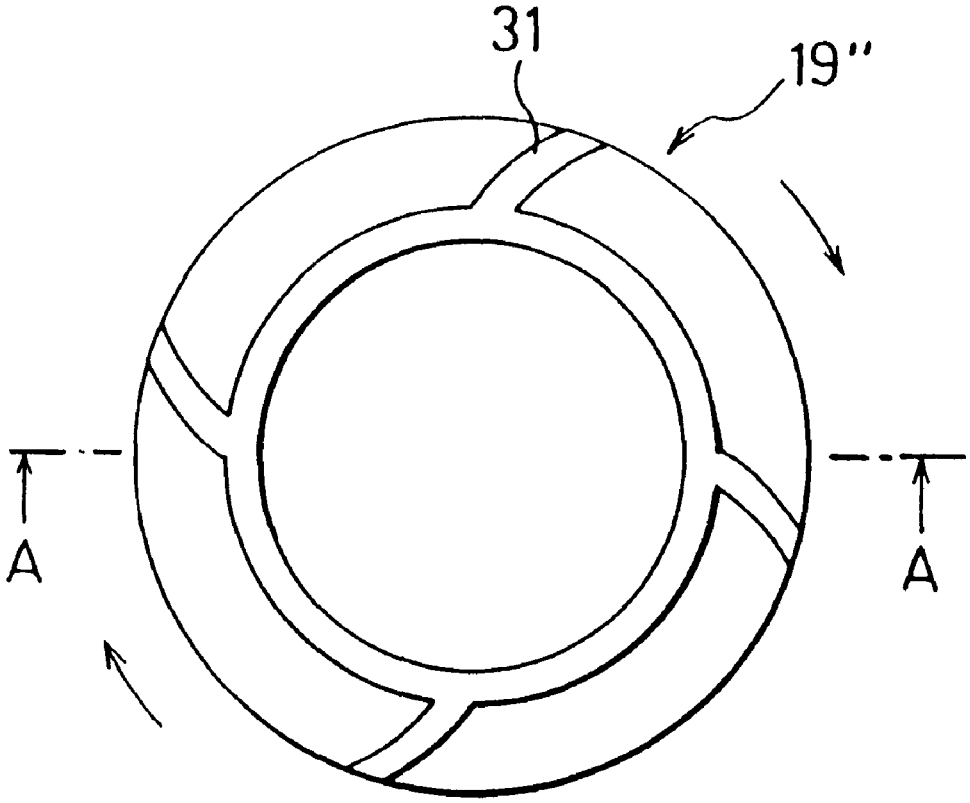
FIGS. 6A and 6B are a plan view of a rear bearing and a cross sectional view taken along an A—A line.
Figure 6B:
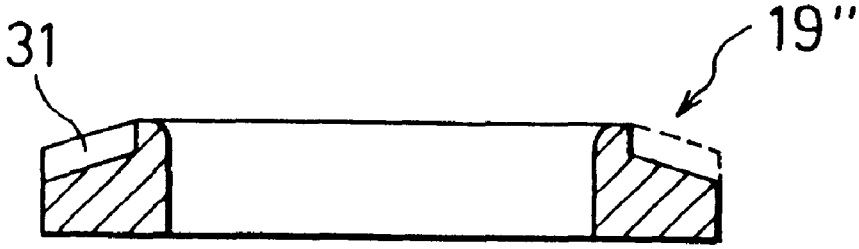

FIG. 6 shows a structure of a rear bearing 19" according to a further embodiment. In this embodiment the rear bearing 19" has fans 31 formed thereon for cooling by force. These fans 31 are so angled as to introduce a cooling liquid or an air from the outer circumference to the inner circumference relative to the rotational direction indicated with arrows (it may be of course introduced in the reverse direction). According to this embodiment, a sliding portion between the rear bearing 19" and the rear thrust bearing 20 can be cooled by force to further improve a cooling effect through the use of the fluid to be pumped as the cooling liquid or the air during an idling run.

The cushion member 18 is arranged separately from the rear bearing 19 in the preceding embodiments, though the rear bearing 19 may have a function as a cushion member effectively in such a case that the rear bearing 19 itself is composed of a resin with a low thermal conductivity.

As described above, according to the present invention, the magnetic can is coupled to the impeller by a pin that passes through both in the radial direction. Therefore, the coupling force at the coupled portion is not lowered with aging and heating as well as an inertial force when the pump inversely rotates or stops. In addition, the magnetic can is coupled to the impeller in the axial and rotational directions by a pin. Therefore, both can be easily decomposed/assembled and their parts are individually changeable.

In addition, according to the present invention, either the rear bearing that is located at the rear end of the rotary bearing or the rear thrust bearing that contacts the rear bearing has such a cross section that reduces a sliding area. Therefore, a heat between the rear bearing and the rear thrust bearing can be suppressed and durability during abnormal runs can be improved.

What is claimed is:

1. A magnetic pump, comprising:

a front casing for forming an interior pump space and having an inlet for drawing in a fluid to be pumped and an outlet for discharging said fluid;

a rear casing for forming a cylindrical space extending from said pump space;

a supporting shaft arranged in said cylindrical space and having a rear end supported by a rear end of said rear casing and a front end facing to said pump space;

a totally cylindrical magnetic can rotatably supported by said supporting shaft and having an inner circumference on which a cylindrical rotary bearing is mounted and an outer circumference on which a driven magnet is mounted;

an impeller secured on a front end of said magnetic can and accommodated in said pump space so as to rotate integrally with said magnetic can;

a rotary driving means magnetically coupled to said driven magnet via said rear casing for supplying a rotary driving force to said impeller via said driven magnet;

a rear bearing arranged at a rear end of said rotary bearing; and a rear thrust bearing arranged at a portion opposite to said rear bearing of said rear casing for contacting said rear bearing when said rotary bearing moves backward during an abnormal run of said pump, wherein said magnetic can and said impeller are fitted with each other in the axial direction and coupled by a pin passing through both in the radial direction.

2. The magnetic pump according to claim 1, wherein a coupling interface between said magnetic can and said impeller comprises a surface extending in the radial direction for transmitting a rotary driving force.

3. The magnetic pump according to claim 1, wherein said pin is inserted through said magnetic can and said impeller from the inner circumference to the outer circumference and is protected by the outer circumference of said rotary bearing so as not to be pulled out.

4. The magnetic pump according to claim 1, wherein said magnetic can is composed of a metallic cylinder and a resin coated on inner and outer circumferences thereof, and wherein a press-fitted portion of said impeller into said magnetic can is sandwiched between said metallic cylinder and said rotary bearing.

5. The magnetic pump according to claim 2, wherein said pin is inserted through said magnetic can and said impeller from the inner circumference to the outer circumference and is protected by the outer circumference of said rotary bearing not to be pulled out.

6. A magnetic pump, comprising:

a front casing for forming an interior pump space and having an inlet for drawing in a fluid to be pumped and an outlet for discharging said fluid;

a rear casing for forming a cylindrical space extending from said pump space;

a supporting shaft arranged in said cylindrical space and having a rear end supported by a rear end of said rear casing and a front end facing to said pump space;

a totally cylindrical magnetic can rotatably supported by said supporting shaft and having an inner circumference on which a cylindrical rotary bearing is mounted and an outer circumference on which a driven magnet is mounted;

an impeller secured on a front end of said magnetic can and accommodated in said pump space so as to rotate integrally with said magnetic can;

a rotary driving means magnetically coupled to said driven magnet via said rear casing for supplying a rotary driving force to said impeller via said driven magnet;

a rear bearing arranged at a rear end of said rotary bearing; and a rear thrust bearing arranged at a portion opposite to said rear bearing of said rear casing for contacting said rear bearing when said rotary bearing moves backward during an abnormal run of said pump, wherein one of said rear bearing and said rear thrust bearing has such a cross section that reduces a sliding area.

7. The magnetic pump according to claim 6, wherein a cushion member for shock absorbing is located between said rear bearing and said rotary bearing.

8. The magnetic pump according to claim 6, wherein said rear bearing has fans formed on a side opposite to said rear thrust bearing for supplying said fluid as a cooling liquid to a sliding portion between said rear bearing and said rear thrust bearing.

9. The magnetic pump according to claim 7, wherein said rear bearing has fans formed on a side opposite to said rear thrust bearing for supplying said fluid as a cooling liquid to a sliding portion between said rear bearing and said rear thrust bearing.

* * * * *